US009814293B2

(12) United States Patent
Houlder

(10) Patent No.: US 9,814,293 B2
(45) Date of Patent: Nov. 14, 2017

(54) MANICURE HAND-REST

(71) Applicant: Adrian Houlder, Maidenhead (GB)

(72) Inventor: Adrian Houlder, Maidenhead (GB)

( * ) Notice: Subject to any disclaimer, the term of this patent is extended or adjusted under 35 U.S.C. 154(b) by 0 days.

(21) Appl. No.: 14/404,534

(22) PCT Filed: May 29, 2013

(86) PCT No.: PCT/GB2013/000245

§ 371 (c)(1),
(2) Date: Nov. 28, 2014

(87) PCT Pub. No.: WO2013/178978

PCT Pub. Date: Dec. 5, 2013

(65) Prior Publication Data

US 2015/0107615 A1 Apr. 23, 2015

(30) Foreign Application Priority Data

May 29, 2012 (GB) ..... 1209542.8

(51) Int. Cl.
*A45D 29/22* (2006.01)
*A45D 29/00* (2006.01)

(52) U.S. Cl.
CPC ..... *A45D 29/22* (2013.01); *A45D 29/00* (2013.01)

(58) Field of Classification Search
CPC ..... A45D 29/00; A45D 29/18; A45D 29/20; A45D 29/22
USPC ..... 132/73; D28/61, 56, 57; 248/118, 118.5, 248/118.1, 118.3
See application file for complete search history.

(56) References Cited

U.S. PATENT DOCUMENTS 262,274 A * 8/1882 Fingerlin ..... B60H 1/267 454/96
2,169,990 A * 8/1939 Preve ..... 132/73
2,262,274 A * 11/1941 Fingerlin ..... 34/202
2,291,125 A * 7/1942 Wilkinson ..... A45D 29/22 132/73

(Continued)

FOREIGN PATENT DOCUMENTS

| | | |
|---|---|---|
| FR | 1 000 606 | 2/1952 |
| GB | 1437768 | 6/1976 |
| GB | 4020071 | 5/2011 |

OTHER PUBLICATIONS

British Search Report Corresponding to GB1309611.0 dated Nov. 14, 2013.

(Continued)

*Primary Examiner* — Tatiana Nobrega
(74) *Attorney, Agent, or Firm* — Davis & Bujold PLLC; Michael J. Bujold

(57) ABSTRACT

A manicure hand-rest which has an upper surface (1) that is contoured in relief with a rear apron (4) for support of either hand and with seven mutually-splayed recesses (6) extending on a forward region (5) from the apron (4) to a contoured peripheral edge (7) of the hand-rest for receiving the fingers and thumb of the respective hand. Of the seven recesses (6), three (63-65) are used by the fore, middle and third fingers of both hands in reverse orders from one another, whereas the thumb and small finger of each hand use respective pairs (61, 66; 62, 67) of the recesses. The ends of the recesses (6) may be bevelled over into the edge (7) to facilitate bending down of the fingertips.

2 Claims, 2 Drawing Sheets

(56) References Cited

U.S. PATENT DOCUMENTS

| | | | | | |
|---|---|---|---|---|---|
| 2,393,371 | A | * | 1/1946 | Harris | 434/100 |
| 2,477,921 | A | * | 8/1949 | Batton | A45D 29/20 132/314 |
| 2,580,981 | A | * | 1/1952 | Webster | A45D 29/00 132/73 |
| D167,672 | S | * | 9/1952 | Blackburn | D28/61 |
| 4,441,487 | A | * | 4/1984 | Daugherty et al. | 601/17 |
| D278,367 | S | * | 4/1985 | Sussman | D28/61 |
| 4,585,017 | A | * | 4/1986 | Trujillo | 132/73 |
| D443,112 | S | * | 5/2001 | Lu | D28/56 |
| D446,353 | S | * | 8/2001 | Crary | D28/61 |
| D617,952 | S | * | 6/2010 | Seychelle | D28/61 |
| 2010/0059077 | A1 | * | 3/2010 | Gerschman | 132/200 |
| 2011/0139169 | A1 | * | 6/2011 | Gerschman | 132/200 |

OTHER PUBLICATIONS

International Search Report Corresponding to PCT/GB2013/000245 dated Aug. 6, 2013.

Written Opinion Corresponding to PCT/GB2013/000245 dated Aug. 6, 2013.

* cited by examiner

MANICURE HAND-REST

This application is a National Stage completion of PCT/GB2013/000245 filed May 29, 2013, which claims priority from British patent application serial no. 1209542.8 filed May 29, 2012.

FIELD OF THE INVENTION

This invention relates to hand-rests for use during manicure.

BACKGROUND OF THE INVENTION

Manicure is concerned especially, though not exclusively, with the treatment and painting of fingernails and includes the application of false nails and nail wraps to the fingers. In all such procedures, whether performed by a manicurist, or by an individual on their own hands, it is desirable for the fingers to be held steady with the fingernails well presented to enable the procedure to be carried out accurately and efficiently. It is an object of the present invention to provide a form of hand-rest that enables this to be achieved.

SUMMARY OF THE INVENTION

According to the present invention there is provided a hand-rest for use during manicure, wherein the hand-rest has an upper surface that is contoured in relief with a rear apron for support of the palm of the hand and with mutually-splayed recesses which each extend from the apron to a forward peripheral edge of the hand-rest and which are for individually receiving for support respective ones of the digits (fingers and thumb) of the hand when the digits are extended from the apron to the forward peripheral edge, and wherein there are more than five but fewer than nine such recesses for receiving individually the five digits of the right-hand or, selectively, the left-hand, with some of the recesses receiving individual digits of both hands.

The hand-rest of the invention, which has the significant advantage that it can be used by either hand selectively, may have seven recesses extending from the apron to the forward peripheral edge with a set of five recesses used for support of the digits of one hand and a different set of five used for the support of the digits of the other hand.

The ends of the recesses at the forward peripheral edge may be bevelled to enable the hand to be positioned on the hand-rest with the tips of some or all of the fingers overhanging or bent down over that edge.

BRIEF DESCRIPTION OF THE DRAWINGS

A manicure hand-rest in accordance with the present invention will now be described, by way of example, with reference to the accompanying drawings, in which.

DETAILED DESCRIPTION OF THE PREFERRED EMBODIMENTS

Figure 1:
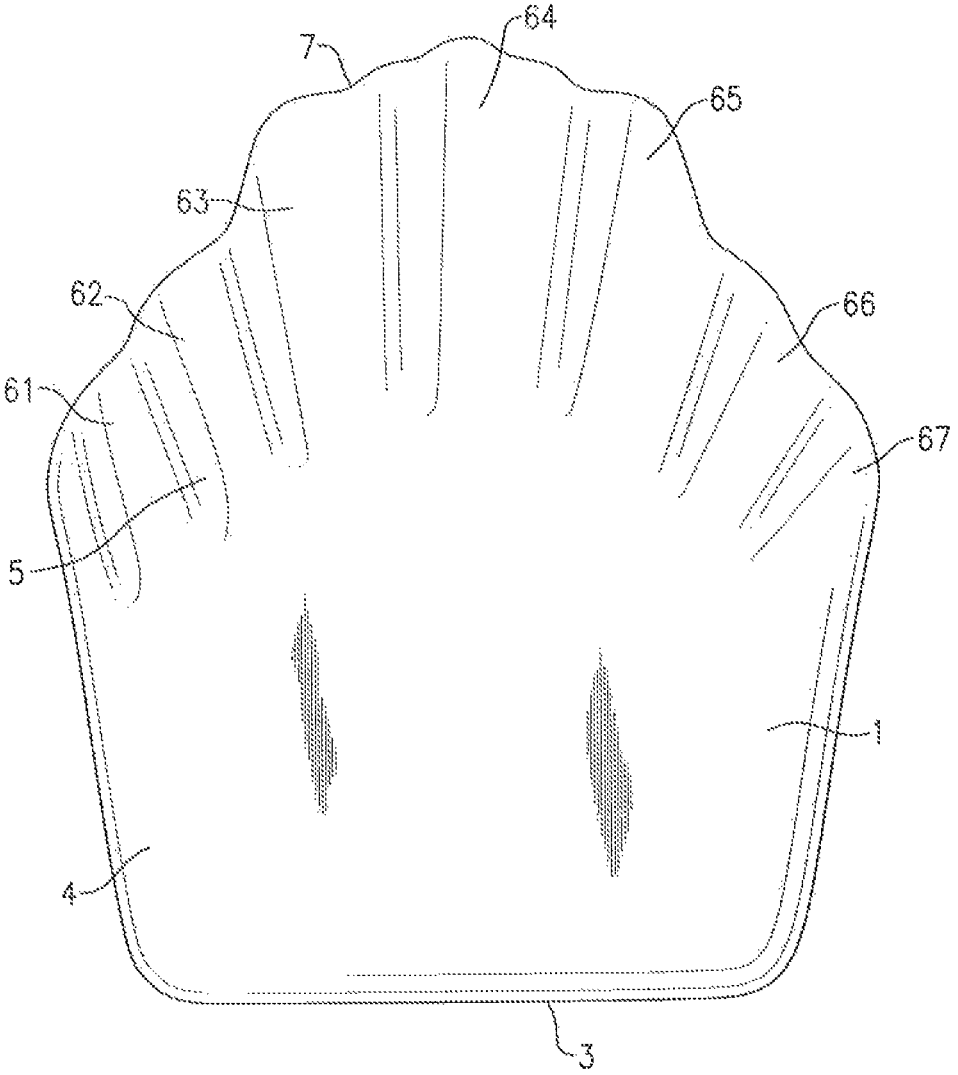
FIG. 1 is a plan view of the hand-rest of the present invention.

The hand-rest of the present example is an aid for use in the manicure of a person's two hands, one at a time. It may be utilised by an individual for manicure of their own hands, or by a manicurist for manicure of the hands of another person. Different sizes of the hand-rest may be provided to cater for variation in hand-size. The hand-rest illustrated in the drawings in this example is for 'medium' hands for which the length of the middle finger is within the range 65-76 millimeter from base to tip; hand-rests for smaller and larger hands, for example having middle-finger lengths of respectively 50-65 millimeter and 76-90 millimeter, may be provided similarly.

Figure 2:
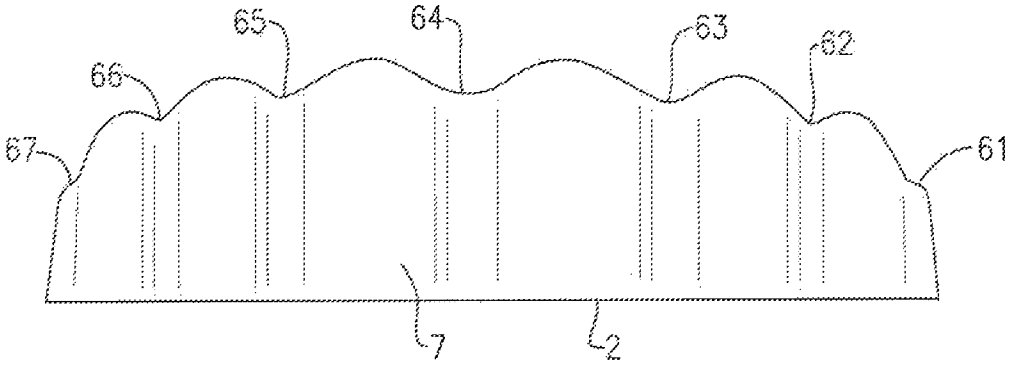
FIGS. 2 and 3 are respectively end and side views of the hand-rest of FIG. 1.
Figure 3:
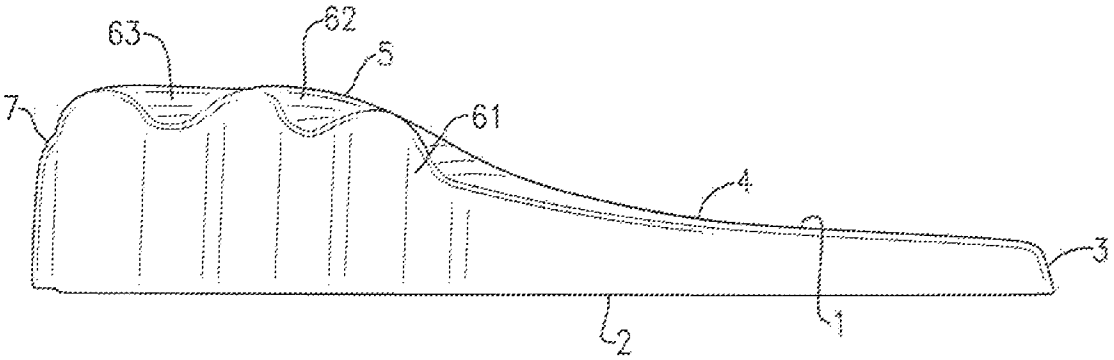

Referring to FIGS. 1 to 3, the hand-rest is of unitary form having, in this example, an overall length and width of 170 millimeter and 155 millimeter respectively, with an upper surface 1 that is configured in relief to provide a comfortable support for either hand of a person receiving manicure treatment. During manicure, the flat base 2 of the hand-rest is located on a firm, generally-horizontal support, and the person's hand, left or right, is placed on the hand-rest to extend longitudinally of it with the heel of the hand adjacent to, or just overhanging, the rear edge 3 of an apron 4 of the rest.

From the edge 3, the apron 4 rises through a gentle-upward curve to round out in a recessed forward region 5 of the hand-rest, and the extended hand is slightly cupped over the apron 4 with the fingers and thumb of either hand, entering respective ones of seven mutually-splayed recesses 6 of the region 5. The seven recesses 6, which are identified in the drawings individually as 61-67, lead smoothly from the apron 4 towards a contoured, peripheral edge 7 of the forward region 5.

The edge 7 is contoured according to the lengths and relative dispositions of the digits of the two hands, and accordingly to the lengths and relative dispositions of the recesses 6 receiving those digits, in order to locate the tips of the fingers and thumb of each hand in their respective recesses 6, close to the edge 7 yet still supported comfortably within those recesses 6 for appropriate treatment. By pushing the hand slightly forward on the apron 4 the digits can be shifted along the recesses 6 to cause the tips of the fingers and thumb to overhang the edge 7. The fingers can continue in the overhang or be bent down over the edge 7 for access in alternative or additional treatment. The ends of the recesses 6 may be bevelled over into the edge 7 to facilitate bending down of the fingertips.

The particular ones of the recesses 6 used and the disposition of the fingers and thumb in them depends on which hand, right or left, is placed on the hand-rest. The digits of the right-hand are received in the five recesses 61 and 63-66, whereas those of the left-hand are received in the five recesses 62-65 and 67 with the dispositions indicated in the following Tables I and II for the right and left hands respectively.

It is to be noted from Tables I and II that recesses 61 and 66 are occupied only by the thumb and small finger respectively of the right-hand with the recesses 62 and 67 unused, whereas recesses 67 and 62 are occupied only by the thumb and small finger of the left hand with the recesses 61 and 66 unused. Accordingly recesses 63-65 are used by both hands and recess 64 by the middle finger in each case.

TABLE I

| Right hand | |
|---|---|
| Digit | Recess |
| Thumb | 61 |
| Fore Finger | 63 |
| Middle Finger | 64 |

TABLE I-continued

| Right hand | |
|---|---|
| Digit | Recess |
| Third Finger | 65 |
| Small Finger | 66 |

TABLE II

| Left Hand | |
|---|---|
| Digit | Recess |
| Thumb | 67 |
| Fore Finger | 65 |
| Middle Finger | 64 |
| Third Finger | 63 |
| Small Finger | 62 |

The hand-rest of the invention provides a simple and economic aid to manicure in that it affords a comfortable way for retention of the hand with digits splayed apart conveniently and positively located for support and ease of individual manicure treatment.

Construction of the hand-rest may be in the solid (for example, of a foamed or other plastics material) as a casting or in machined form, or may be thermoformed in a plastics material. It is desirable that the surface 1 presents a smooth finish that can be readily cleaned.

The invention claimed is:

1. A hand-rest for use during manicure, the hand-rest comprising:

a body having a flat base by which the hand-rest is supported during use of the hand-rest, a top surface on which a user's hand is placed during use and a front face, a rear face and right and left side faces extending between the flat base and the top surface, the body having a forward region and an apron extending proximally from the forward region;

the rear face defines a terminal proximal end of the hand-rest where opposing right and left ends of the rear face are curved and the right and left side walls extend linearly outward at an angle from the curved ends of the rear face, and the rear face merges with the top surface to define a rear edge;

the front face defines a terminal distal end of the hand-rest, extending inwardly in a distal direction from a distal-most portion of the right and left side faces to converge at a central apex, where the front face has an irregularly curved shape having a plurality of undulations and the front face merges with the top surface to define a forward peripheral edge;

a length of the hand-rest measured from the apex of the front face to the rear face being longer than a width of the hand-rest measured from the right side face to the left side face, a rear portion of the top surface at the apron for accommodating a heel of a hand of a user adjacent to the rear edge of the apron and a front portion of the top surface at the forward region being configured for accommodating fingers and a thumb of the user, and the apron having a gentle curve extending upwardly in a direction away from the flat base, the curve transitions from the rear portion of the apron into the forward region, first, second, third, fourth, fifth, sixth, seventh and eighth spaced apart peaks are arranged along the front portion of the apron in a spaced relationship to one another, the first peak being located closely adjacent an interface formed between the right side face and the front face while the eighth peak being located closely adjacent an interface between the left side face and the front face, and the second, third, fourth, fifth, sixth and seventh peaks being located, in order from right to left, between the first and the eighth peaks, a height of the first and the eighth peaks measured relative to the flat base, being less than a height of the second through the seventh peaks measured relative to the flat base, seven splayed recesses extending from the front portion of the apron to the forward peripheral edge, with each of the seven splayed recesses being located between a pair of adjacent peaks such that the first recess is between the first and second peaks, the second recess is between the second and third peaks, the third recess is between the third and fourth peaks, the fourth recess is between the fourth and fifth peaks, the fifth recess is between the fifth and sixth peaks, the sixth recess is between the sixth and seventh peak and the seventh recess is between the seventh and eighth peaks, wherein the third, fourth and fifth recesses are longer than the first, second, sixth and seventh recesses for placement of fore, middle and third fingers in the third, fourth and fifth recesses and placement of the thumb and small finger in the first, second, sixth and seventh recesses;

each one of the seven splayed recesses smoothly transitions from the front portion of the apron to the front face, each one of the seven splayed recesses has a size and shape for accommodating a single finger or the thumb of either hand of the user, a respective bevel is provided between a front portion of each of the seven splayed recesses and the front face of the hand-rest to facilitate bending of tips of the fingers and the thumb of the user over the front edge of the hand rest, each of the seven splayed recesses having a length and a relative disposition, with respect to one another, for receiving the finger or the thumb of either hand of the user and facilitate locating tips of the fingers and the thumb, of either hand, closely adjacent to the forward peripheral edge of the hand-rest, and when the fingers or the thumb of the user are supported within the respective splayed recesses, movement of the hand of the user slightly forward, relative to the apron, causes the tips of the fingers and the thumb to overhang the forward peripheral edge of the hand-rest and thereby facilitate improved access to the tips of the fingers and the thumb during the manicure.

2. The hand-rest according to claim 1, wherein the hand-rest has a length of 6.69 inches (170 millimeters) and a width of 6.10 inches (155 millimeters).

* * * * *